US005495219A

United States Patent [19]

Arnold

[11] Patent Number: 5,495,219

[45] Date of Patent: Feb. 27, 1996

[54] CIRCUIT BREAKER WITH IMPROVED MAGNETIC TRIP RESPONSE

[75] Inventor: David Arnold, Chester, Conn.

[73] Assignee: General Electric Company, New York, N.Y.

[21] Appl. No.: 584,323

[22] Filed: Aug. 2, 1994

[51] Int. Cl.[6] ..... H01H 9/00

[52] U.S. Cl. ..... 335/172; 335/167

[58] Field of Search ..... 335/172–176, 335/167–171, 23, 24, 25, 35, 177–179

[56] References Cited

U.S. PATENT DOCUMENTS

| | | | |
|---|---|---|---|
| 4,284,968 | 8/1981 | Denoyelle et al. | 335/176 |
| 4,672,501 | 6/1987 | Bilac . | |
| 4,808,952 | 2/1989 | Berner | 335/172 |
| 4,864,263 | 9/1989 | Castonguay . | |
| 4,907,342 | 3/1990 | Castonguay . | |

OTHER PUBLICATIONS

Morris et. al, "Induction Motor Protective Circuit Breaker Unit." U.S. Ser. No. 08/140,928 (Docket: 41PR–7065).

*Primary Examiner*—Lincoln Donovan
*Attorney, Agent, or Firm*—Richard A. Menelly

[57] ABSTRACT

An industrial-rated circuit breaker includes an electronic trip unit for long time, short time and instantaneous overcurrent protection. Current transformers contained within the circuit breaker enclosure sample the circuit current and supply the trip unit with signals indicative of the circuit current in real time. Upon receipt of an overcurrent condition the trip unit actuates the circuit breaker operating mechanism to separate the circuit breaker contacts for circuit interruption. A supplemental magnet trip actuator interacts with the current transformer and the operating mechanism to provide enhanced short circuit response.

7 Claims, 4 Drawing Sheets

CIRCUIT BREAKER WITH IMPROVED MAGNETIC TRIP RESPONSE

BACKGROUND OF THE INVENTION

U.S. Pat. No. 4,672,501 describes a circuit interrupter that utilizes an electronic trip unit to determine and act upon overcurrent conditions occurring within a protected circuit. The long time, short time and instantaneousness overcurrent conditions are electronically determined and an operating mechanism is actuated to separate the circuit breaker contacts to interrupt the circuit.

In some applications, it would be more beneficial to directly actuate the circuit breaker operating mechanism to interrupt the circuit without having to sense the circuit current and make the determination electronically before actuating the operating mechanism, especially when a short circuit condition occurs and some damage could occur to the circuit breaker contacts.

In other applications of an electronic trip unit for overcurrent determination, such as within motor control centers, supplemental fuses are used in combination with the circuit breakers to provide such short circuit protection in view of the fast interruption provided by the fuse disintegration. U.S. patent application Ser. No. 08/140,928 filed on Oct. 25, 1993 entitled "Induction Motor Protective Circuit Breaker" discloses the provision of a fast action fuse in circuit with a circuit breaker to provide enhanced short circuit protection.

One purpose of the instant invention is to provide enhanced short circuit protection to a circuit interrupter employing an electronic trip unit without requiring an additional fuse.

SUMMARY OF THE INVENTION

A supplemental magnet trip actuator is incorporated within the current transformer assembly and the operating mechanism of a circuit breaker with an electronic trip unit to provide enhanced short circuit protection facility. An armature interacts with the current transformer core and a drive link to directly articulate the operating mechanism without requiring a trip output signal from the trip unit.

DESCRIPTION OF THE PREFERRED EMBODIMENT

Figure 1:
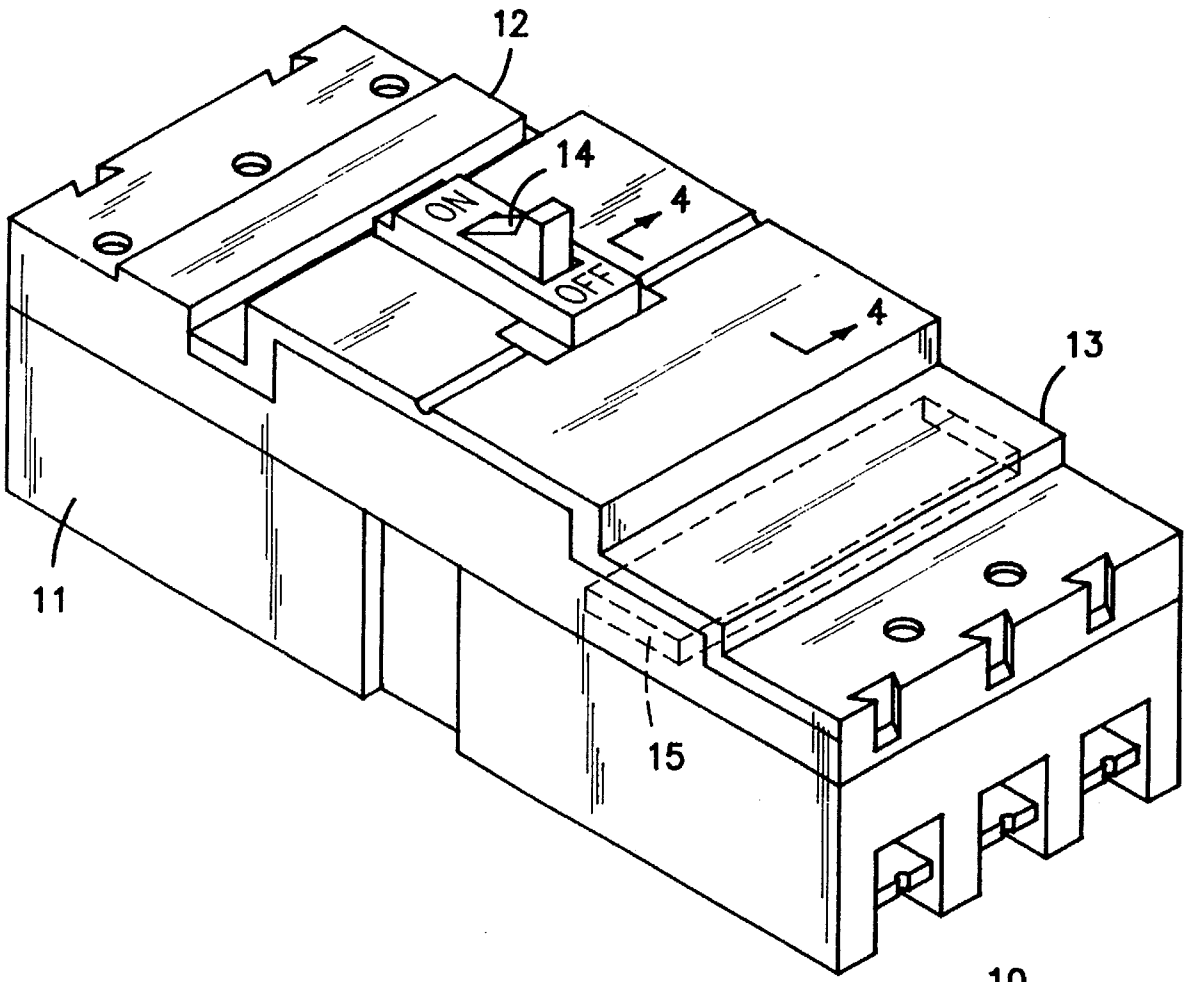
FIG. 1 is a top perspective view of a circuit breaker employing an electronic trip unit for overcurrent determination and interruption.

In accordance with the invention, an industrial-rated circuit breaker 10, shown in FIG. 1 consists of a molded plastic case 11 to which a cover 12 and accessory cover 13 of the same material are attached. The ON and OFF conditions of the circuit breaker contacts (not shown) are manually controlled by an extending handle operator 14. The automatic separation of the circuit breaker contacts upon the condition of an overcurrent condition is controlled by the electronic trip unit 15 accessible by means of the accessory cover. The trip unit circuit is described in U.S. Pat. No. 4,672,501 and the operating mechanism controlling the circuit breaker contacts is described within U.S. Pat. No. 4,864,263.

Figure 2:
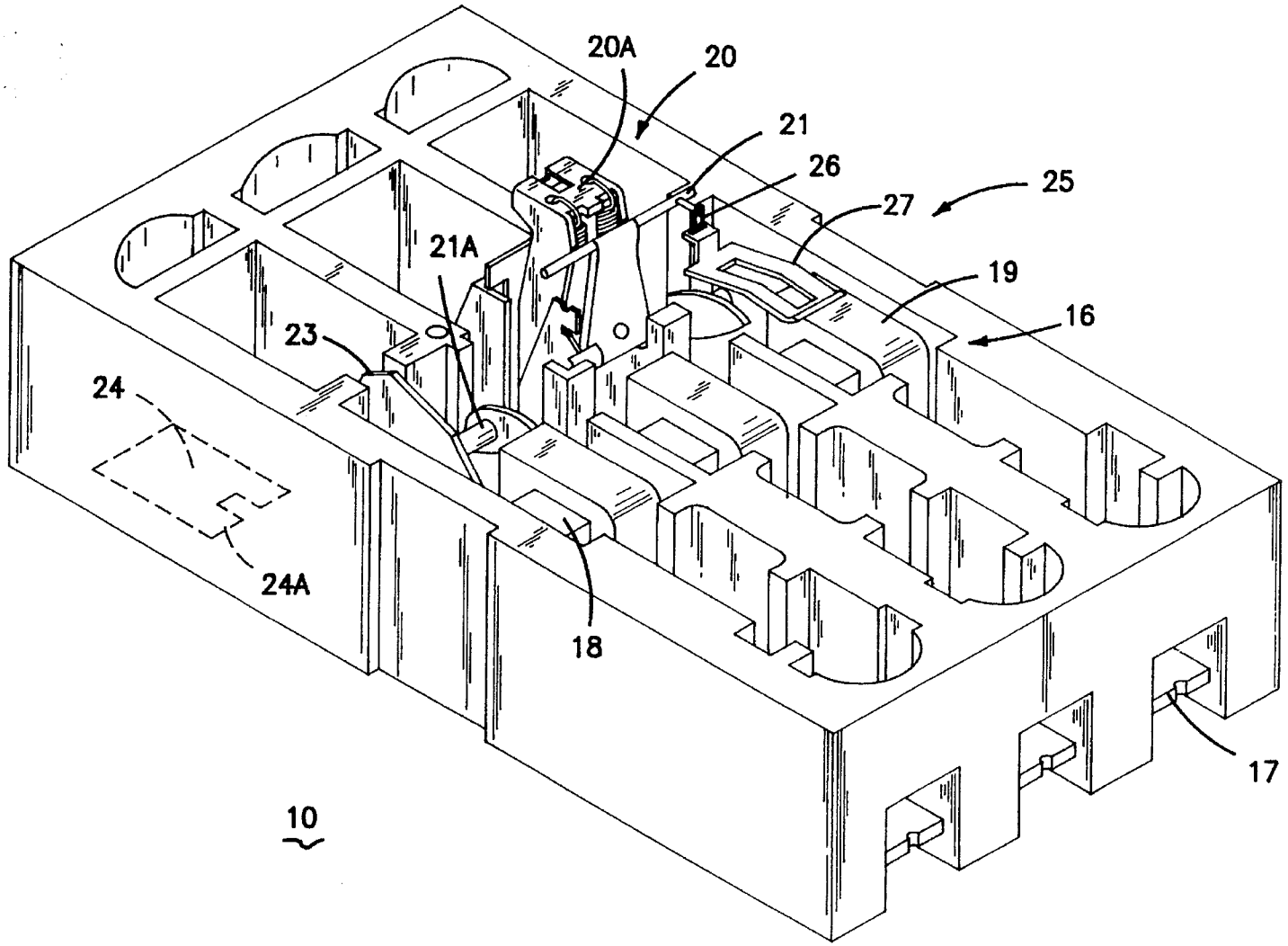
FIG. 2 is a top perspective view of a circuit breaker having an electronic trip unit with the cover removed to depict the current transformers and the supplemental magnetic trip actuator in accordance with the invention.

The circuit breaker 10 is shown in FIG. 2 with the cover and accessory cover removed to depict the position of the supplemental magnetic trip unit "SMTU" relative to the current transformers 25 and the circuit breaker operating mechanism 20. The current transformers are described within U.S. Pat. No. 4,907,342 and the operating mechanism is similar to that disclosed within the aforementioned U.S. Pat. No. 4,864,263. The current transformers are arranged at one end of the load straps 17 and include a magnetic core 18 along with the secondary winding 19. The operating lever 27 on the SMTU interacts with the trip bar 21 on the operating mechanism via a linkage 26 which will be described below in greater detail. As described within the aforementioned U.S. Pat. No. 4,864,263 the trip cradle 21 releases the operating mechanism springs to rotate the cross bar 21A and drive the movable contact arms 22 and attached movable contacts 23 away from the from the fixed contacts 24 on the contact supports 24A to interrupt each phase within the associated electrical distribution system.

Figure 3:
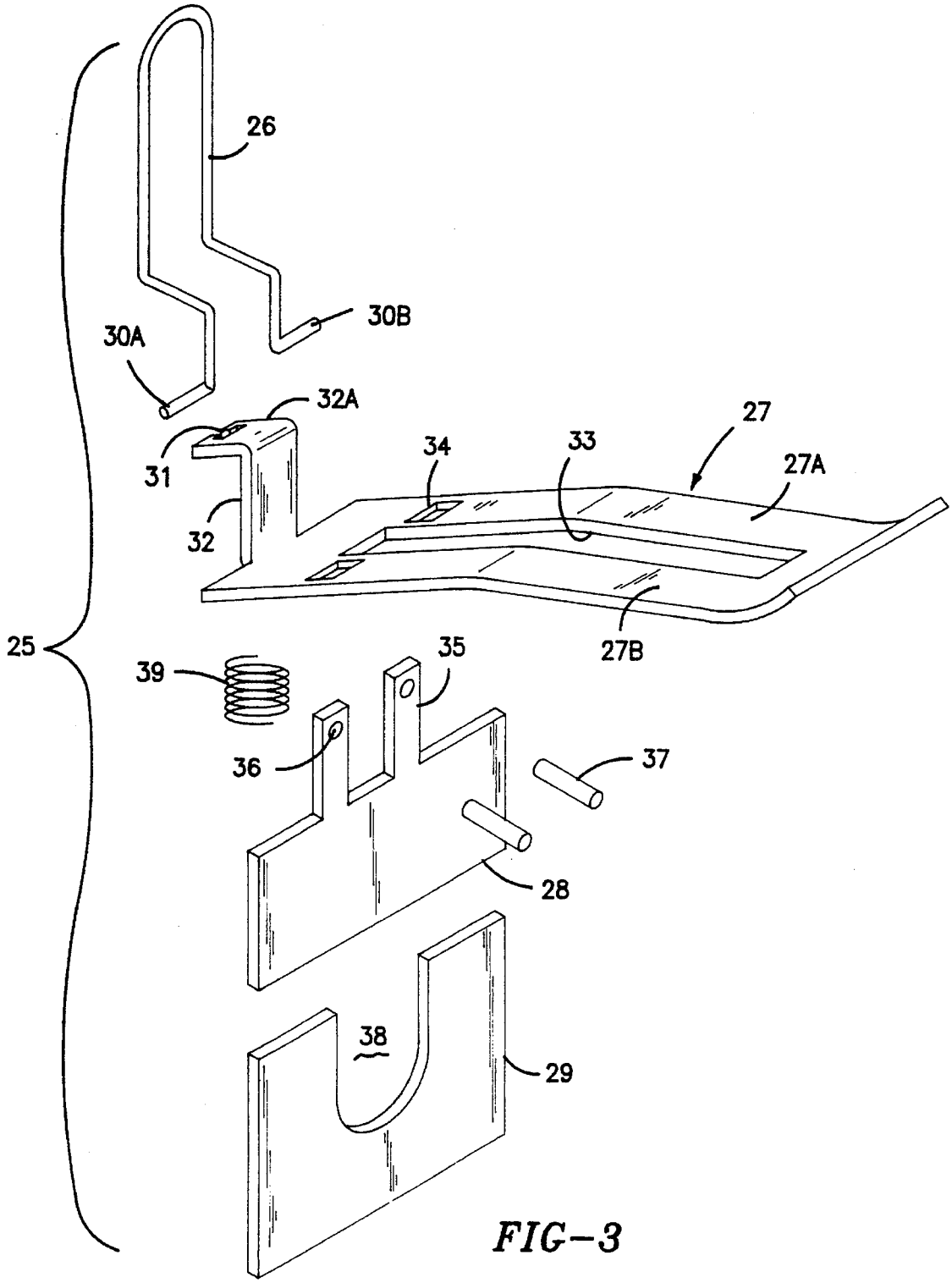
FIG. 3 is an enlarged top perspective view of the components used within the magnetic trip actuator of FIG. 2.

The SMTU 25 is shown in FIG. 3 to consist of a planar magnet 29 with a U-shaped slot 38 formed to allow the magnet to abut the magnetic core 18 shown earlier in FIG. 2. The armature 28 is next positioned above the magnet 29 and is fastened to the operating lever 27 by insertion of the upstanding arms 35 within slots 34 and inserting pins 37 through the openings 36. The knee-shaped arrangement of the operating lever sides 27A, 27B terminating at the pivot 12A allows lever 27 to respond to the downward pull of the armature 28 against the bias of the return spring 39 as will be shown below. The operating lever is shaped to include a vertical tab 32 terminating in an off-set tab 32A which includes a slot 31. The trip link 26 is pivotally-attached to the operating lever by insertion of the extensions 30A, 30B at the bottom of the trip link within the slot 31 formed within the off-set tab 32A.

Figure 4:
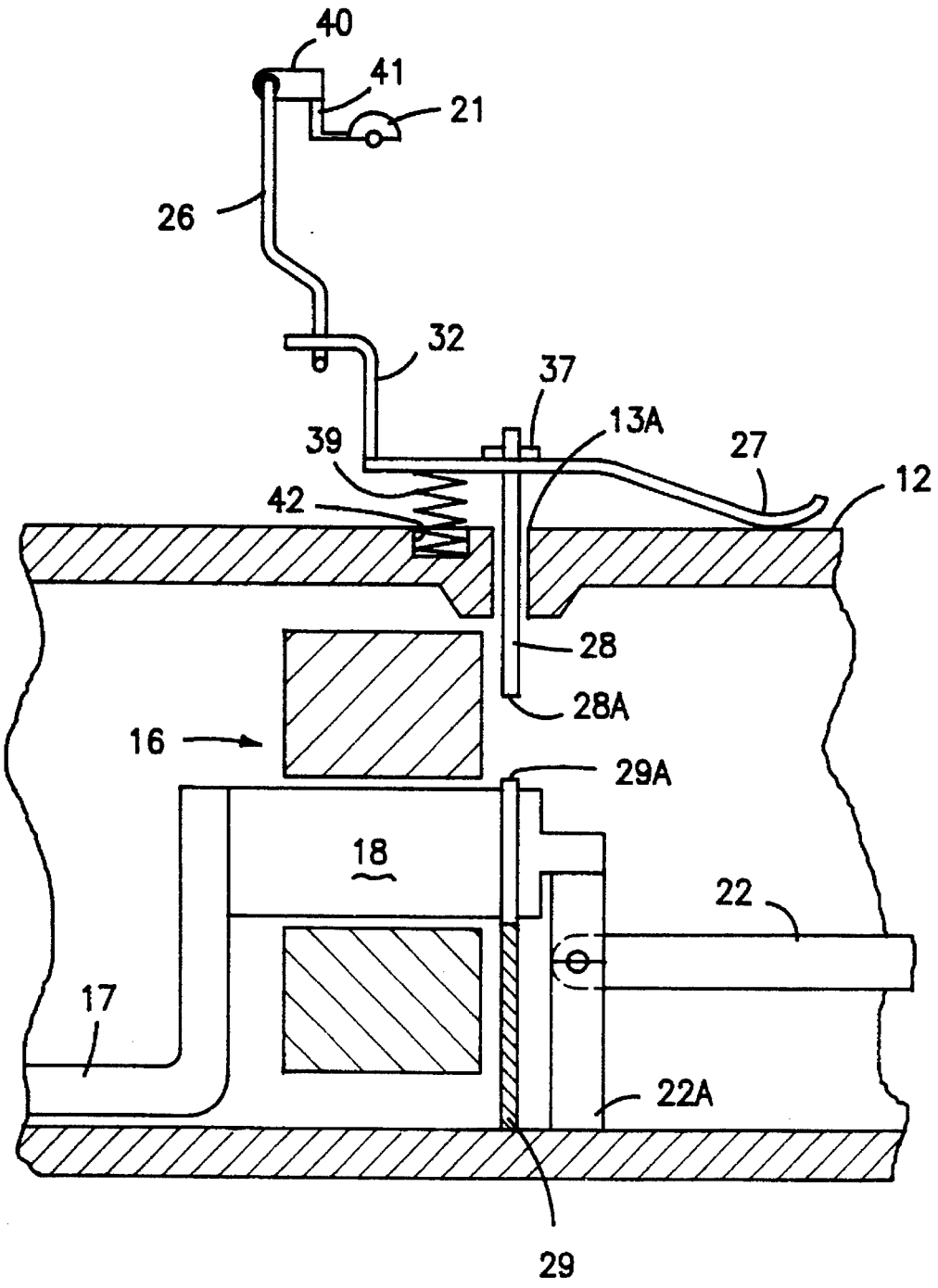
FIG. 4 is an enlarged side perspective view in partial section of the supplemental magnetic trip actuator within the circuit breaker of FIG. 2.

The operation of the SMTU 25 is best seen by now referring to FIG. 4 wherein the magnet 29 is positioned against the front of the current transformer 16 with the slot 38 arranged to accommodate that part 17A of the load strap 17 that passes through the magnetic core 18 about which the secondary winding 19 is arranged. The load strap connects with the movable contact arm 22 by means of the contact arm support 22A. When the remaining components of the SMTU are positioned above the circuit breaker cover 12, one end of the operating lever 27 is arranged over the return spring 39, one end of which is supported within the recess 42 formed in the cover 12. The upward bias provided by the return spring is balanced by the interaction of the lever 27 and cover 12 at pivot 12A and by the interaction of the armature 28 and cover 12 at the stop surface 28B where the armature is pivotally-attached to the lever by means of pins 37. The armature 28 attached to the lever 27 by means of the pins 37 is positioned above the magnet 29 such that a magnetic gap is defined between the end 28A of the armature and the end 29A of the magnet.

The predetermined gap accurately sets the short circuit over-ride force that by-passes the signals generated by the current transformer that are acted upon by the trip unit 15 of FIG. 1 and instantly articulates the operating mechanism to drive the movable contact arm 22 to the OPEN position. This is brought about by the magnetic force exerted on the armature 28 in the downward indicated direction which pulls the armature, lever 27, and link 26in the downward direction to rotate the arm 41 about the pivot 40 away from the trip cradle 21. It has been determined that the provision of the SMTU within circuit breakers that contain electronic trip units and current transformers to sense and act upon overcurrent conditions has substantially decreased the interruption time required for short circuit overcurrent conditions. The beneficial results with the enhanced interruption speed under such intense overcurrent conditions are reflected in the increased operating life for circuit breaker contacts which could otherwise become heated during the inertial time restraints existing with circuit breaker additional components that interface between the circuit breaker electronic trip unit and the circuit breaker operating mechanism.

I claim:

1. A circuit breaker having enhanced short circuit interruption capability comprising:

A pair of separable contacts controlled by means of an operating mechanism to drive said contacts between closed and open positions;

a current transformer including a magnetic core and connecting with said contacts for receiving circuit current;

an electronic trip unit connecting with said current transformer and interacting with said operating mechanism to articulate said operating mechanism upon occurrence of an overcurrent condition within a protected circuit; and a planar magnet arranged for interfacing with said magnetic core;

a planar armature separated from said planar magnet by a predetermined magnetic gap separation distance;

a lever attached to said armature and arranged for motion is response to movement of said armature toward said magnet;

means biasing said lever to a rest position in opposition to movement of said armature; and a link connecting with said lever and arranged for articulating a circuit breaker operating mechanism in response to movement of said armature toward said magnet.

2. The circuit breaker of claim 1 wherein said planar magnet includes a shaped slot for accommodating a circuit breaker load conductor.

3. The circuit breaker of claim 1 wherein said planar magnet wherein said planar armature includes a pair of upstanding tabs arranged for insertion within corresponding slots in said lever.

4. The circuit breaker of claim 1 wherein said bias means comprises a compression spring.

5. The circuit breaker of claim 1 wherein said lever comprises a rectangular configuration extending a plane parallel to said armature.

6. The circuit breaker of claim 1 wherein said lever further includes an upright tab extending perpendicular to said rectangular configuration and terminating at an off-set tab.

7. The circuit breaker of claim 1 wherein said lever interconnects within a slot formed within said off-set lever.

* * * * *